US011591809B2

(12) United States Patent
Sighinolfi

(10) Patent No.: US 11,591,809 B2
(45) Date of Patent: Feb. 28, 2023

(54) LEVELLING SPACER DEVICE FOR SLABS

(71) Applicant: RAIMONDI S.P.A., Modena (IT)

(72) Inventor: Riccardo Sighinolfi, Rubiera (IT)

(73) Assignee: RAIMONDI S.P.A., Modena (IT)

( * ) Notice: Subject to any disclaimer, the term of this patent is extended or adjusted under 35 U.S.C. 154(b) by 0 days.

(21) Appl. No.: 17/382,631

(22) Filed: Jul. 22, 2021

(65) Prior Publication Data

US 2022/0025662 A1 Jan. 27, 2022

(30) Foreign Application Priority Data

Jul. 23, 2020 (IT) ..... 102020000017881

(51) Int. Cl.
*E04F 21/22* (2006.01)
*E04F 21/00* (2006.01)

(52) U.S. Cl.
CPC ..... *E04F 21/22* (2013.01); *E04F 21/0092* (2013.01)

(58) Field of Classification Search
CPC ..... E04F 21/0092; E04F 21/22; E04F 21/1844; E04F 21/1877; E04F 13/0892; E04F 15/02005
See application file for complete search history.

(56) References Cited

U.S. PATENT DOCUMENTS

| | | | | |
|---|---|---|---|---|
| 9,534,403 | B2 * | 1/2017 | Biec | E04F 21/0092 |
| 9,970,203 | B1 * | 5/2018 | Abidov | E04F 21/1877 |
| 2015/0308130 | A1 * | 10/2015 | Biec | E04F 21/0092 52/749.11 |
| 2016/0222679 | A1 | 8/2016 | Bunch et al. | |
| 2018/0291640 | A1 | 10/2018 | Sighinolfi | |
| 2019/0169863 | A1 * | 6/2019 | Torrents Comas | E04F 21/1877 |
| 2020/0149295 | A1 * | 5/2020 | Mendiluza | E04F 21/0092 |
| 2020/0224434 | A1 * | 7/2020 | Troxell | E04F 21/22 |
| 2021/0062522 | A1 * | 3/2021 | Castellanos | E04F 21/0092 |

FOREIGN PATENT DOCUMENTS

| | | | |
|---|---|---|---|
| CN | 204876506 | U | 12/2015 |
| EP | 3569793 | A1 | 11/2019 |
| EP | 3584389 | A1 | 12/2019 |
| WO | 2018227250 | A1 | 12/2018 |
| WO | 2019194808 | A1 | 10/2019 |

* cited by examiner

*Primary Examiner* — Babajide A Demuren
(74) *Attorney, Agent, or Firm* — Browdy and Neimark, PLLC

(57) ABSTRACT

A levelling spacer device for laying slab-shaped products including a base having a lower surface and an opposite upper surface defining a support plane for at least two tiles placed side by side, which is placed at a first distance from the lower surface, a spacer bridge provided with two legs placed side by side between each other along a flanking direction and each one rising from a portion of the opposite upper surface. Each leg is frangibly connected to the respective base portion by a predefined fracture line placed at a second distance from the lower surface greater than the first distance. A crosspiece, joins the top of the two legs, and a through opening peripherally delimited at the top by the crosspiece, laterally by the legs and at the bottom by a central portion of the upper surface coplanar with the support plane.

13 Claims, 7 Drawing Sheets

LEVELLING SPACER DEVICE FOR SLABS

TECHNICAL FIELD

The present invention relates to a levelling spacer device for the laying of slab-type manufactured products, such as tiles, slabs of natural stone or the like, for coating surfaces, such as walkable surfaces, floors, wall and ceiling coverings or the like.

PRIOR ART

In the sector of tile laying for coating surfaces, such as floors, walls and the like, the use of spacer devices is known which, in addition to equally spacing the tiles placed side by side, allow their planar arrangement, such devices are commonly called levelling spacer devices.

The levelling spacer devices of the known type generally comprise a base, which can be positioned below the laying surface of at least two adjacent tiles, from which at least a spacer bridge protrudes, adapted to contact, by means of its lateral sidewalls, the facing sidewalls of the two tiles to be placed side by side on the laying surface.

The levelling spacer device is then provided with a pressure wedge adapted to wedge between a crosspiece of the spacer bridge and the surface, in view, of the tiles resting on the base, so as to press the visible surfaces of the tiles towards the base, levelling them.

The bridge is then removed by separation from the base following the solidification of the tile laying adhesive, leaving, for single-use, the base underneath the tile laying surface incorporated in the solidified adhesive.

A need felt in these levelling spacer devices is to optimise the fracture of the bridge once it has performed its task and, at the same time, to reduce as far as possible the volume taken away from the adhesive by the portion of the levelling spacer device that remains incorporated therein following the fracture, in particular in the interspace (joint) zone defined between the two tiles separated by the separator bridge.

A further need felt is to increase as much as possible the zones of the tile that are not in direct contact with the adhesive, so that the tile can adhere well to the surface to be coated by the adhesive.

Again, a need felt in these levelling spacer devices is to make the separation of the bridge from the base particularly effective and simple once the adhesive has hardened and, at the same time, to make the zone intended to trigger the separation between the bridge and the base sufficiently strong and resilient, in such a way as to avoid or limit the risk of accidental separations between the bridge and the base either during transport or storage of the levelling spacer devices or during their use before the desired moment or elastic or elasto-plastic deformations of the bridge during the traction exerted thereon by the wedge.

An object of the present invention is to satisfy the aforesaid needs of the prior art, within the framework of a simple, rational and low cost solution.

Such objects are achieved by the characteristics of the invention given in the independent claim. The dependent claims outline preferred and/or particularly advantageous aspects of the invention.

DISCLOSURE OF THE INVENTION

The invention, in particular, provides a levelling spacer device for the application of slab-type products for coating surfaces, comprising:

at least a base having a lower surface and an opposite upper surface defining a support plane for at least two slab-shaped products placed side by side, wherein the support plane defined by the upper surface is placed at a first distance from the lower surface;

a spacer bridge provided with:

two legs placed side by side between each other along a flanking direction and each one rising from a respective portion of the upper portion of the base in a direction orthogonal to the support plane, wherein each leg is frangibly connected to the respective base portion by a predefined fracture line placed at a second distance from the lower surface greater than the first distance, wherein the fracture line is formed by a longitudinal cut with a longitudinal axis that is parallel to the flanking direction; and a crosspiece, which joins the top of the two legs along the flanking direction; and a through opening adapted to be crossed by a pressure wedge along a crossing direction orthogonal to the flanking direction, wherein the through opening is peripherally delimited at the top by the crosspiece of the bridge, laterally by the legs of the bridge and at the bottom by a central portion of the upper surface of the base coplanar with the support plane.

In addition, the longitudinal cut forming the fracture line can advantageously extend over the entire width of the respective leg.

Again, the crosspiece may be asymmetrical with respect to a median plane of the base orthogonal to the crossing direction.

Advantageously, the base may comprise a pair of opposite eyelets passing from the lower surface to the upper surface that are open at opposite distal ends by a median plane of the base orthogonal to the crossing direction, each eyelet having lateral sides converging between each other towards the median plane.

In addition, the upper surface of the base may comprise a pair of opposite surfaces tilted at the base ends distal from the bridge and opposite thereto, wherein each tilted surface defines a ramp rising from the base end towards the bridge, in a direction parallel to the crossing direction, and which connects the lower surface of the base to the support plane defined by the upper surface of the base.

Again, each eyelet can be configured to cut a respective tilted surface splitting it in two.

According to one aspect of the invention, the upper surface of the base may be (prevalently) planar, the support plane defined by the upper surface extending over most of the upper surface.

For example, "most" or "prevalently" means greater than 50% of the total extension of the upper surface (i.e. greater than 50% of the total extension of the lower surface of the base), preferably greater than 70% (or even 80%) of the total extension of the upper surface.

In addition, preferably "planar" means perfectly flat or substantially flat, e.g. planar lower than machining tolerances (to facilitate the removal of the base from the mould).

Advantageously, the central portion of the upper surface delimiting the through opening (i.e. It is aligned in plan with the crosspiece of the bridge) extends longitudinally between the two legs (i.e. between the two lower ends thereof), preferably over a length lower than (or at most equal to) a length of a shaped edge of the crosspiece facing the upper surface of the base and extending longitudinally between the tops of the two legs delimiting the through opening at the top.

Advantageously, each leg has a respective connecting foot which protrudes from an inner side of the respective leg projecting into the through opening, wherein each connecting foot has a bottom joined to the upper surface of the base (and which derives therefrom as one body), a proximal lateral end joined to the respective leg (and which derives therefrom), a free distal end separated from the distal end of the other connecting foot (and protruding towards a median plane of the base parallel to the crossing direction but is distant therefrom) and a top wall facing the crosspiece, wherein the top wall of each connecting foot has a maximum distance from the lower surface of the base lower than or equal to the second distance and is preferably tilted by an acute angle with respect to the support plane so as to define a ramp rising from the distal end to the proximal end.

In other words, the connecting foot has a substantially triangular or trapezoidal shape when viewed along a direction parallel to the crossing direction. Preferably, the connecting foot substantially has the shape of a right-angled triangle or a right-angled trapezoid, wherein the right angle is defined between the bottom and the proximal end.

The connecting feet have the important function of strengthening the base during the fracture of the bridge from the base.

In fact, it has been observed that especially (or only) when the person in charge of laying the flooring removes the bridges before the adhesive has fully hardened or has a predetermined degree of hardening (i.e. is still soft and allows the base some degree of freedom of movement), the impact on the bridge which is used to effect the tear along the fracture line, may in fact cause the base to tear along a tear line substantially parallel to the crossing direction and proximal to the leg of the bridge that is the furthest from the point of application of the impact on the bridge. This tearing of the base could make the subsequent removal of the bridge from the flooring difficult and not easy.

The presence of the connecting feet makes it possible to counteract this accidental tearing and to direct and/or distribute the stress imparted by the impulsive impact on the bridge (thanks to the aforesaid ramp rising from the base towards the predetermined fracture line of the respective leg) towards the correct tearing position, i.e. towards the aforesaid predetermined fracture line made in the leg.

Advantageously, the distal end may be placed at a minimum distance from the lower surface of the base greater than or equal to the first distance, preferably equal to the first distance (i.e. coplanar with and concealed in the support plane); the proximal end may be placed at the maximum distance from the lower surface of the base lower than or equal to the second distance, preferably equal to the second distance (i.e. so as to join an axial end of the predetermined fracture line), wherein in general the minimum distance is lower than the maximum distance.

For example, the top wall is planar (i.e. it lies on a plane tilted at an acute angle, preferably lower than 45°, with respect to the support plane) or arched (preferably along an arc of circumference), e.g. concave (with concavity facing towards the crosspiece) or convex.

Again, the distal ends of the two connecting feet are distant from each other by a distance equal to a length of the central portion of the upper surface, preferably greater than a thickness (e.g. the thickness defining the width of the joint) of a leg in the crossing direction.

In practice, the central portion of the base (which is coplanar with the support plane defined by the upper surface of the base) extends longitudinally between the distal ends of the two connecting feet and is lengthened axially (on both sides) by the two rising ramps (towards the predetermined fracture lines of the legs) defined by the top walls of the connecting feet.

BRIEF DESCRIPTION OF THE DRAWINGS

Further features and advantages of the invention will be more apparent after reading the following description provided by way of non-limiting example, with the aid of the accompanying drawings.

BEST MODE OF THE INVENTION

Figure 1:
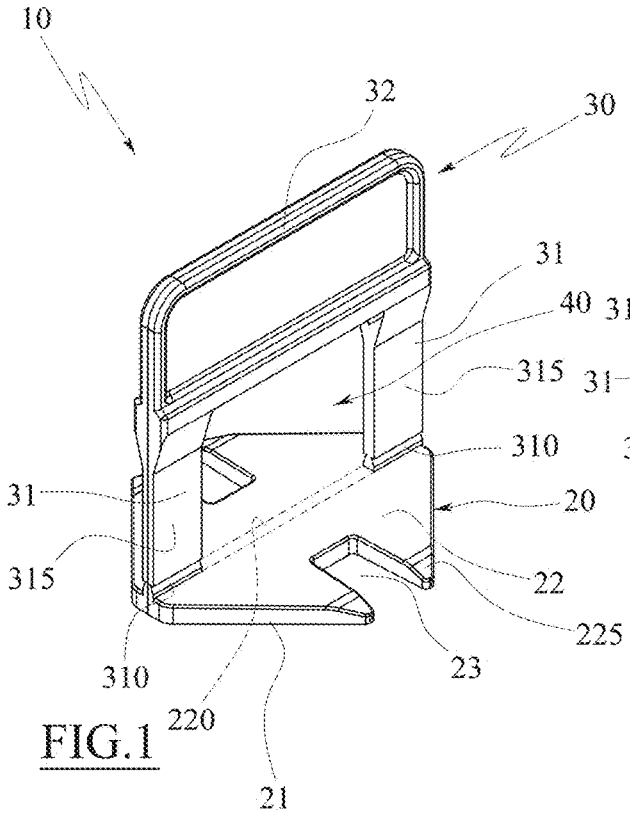
FIG. 1 is an axonometric (front) view of a levelling spacer device, according to a first embodiment of the invention.
Figure 2:
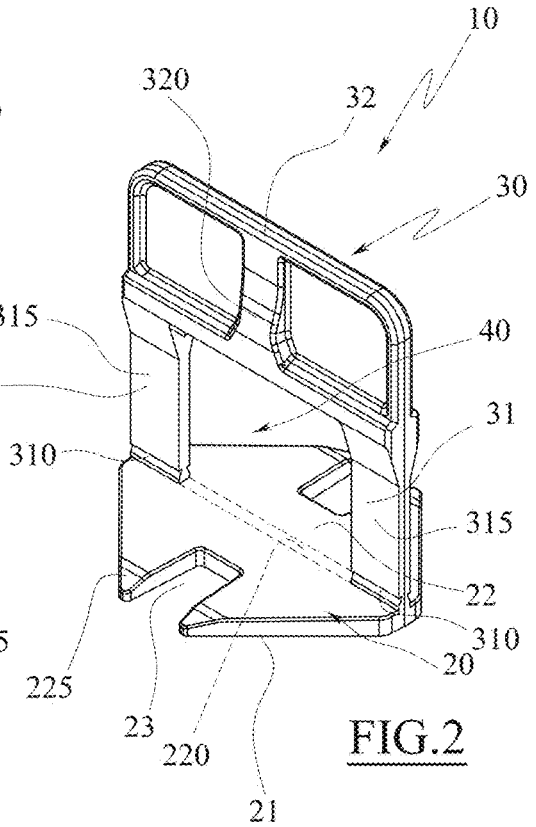
FIG. 2 is an axonometric (rear) view of FIG. 1.
Figure 3:
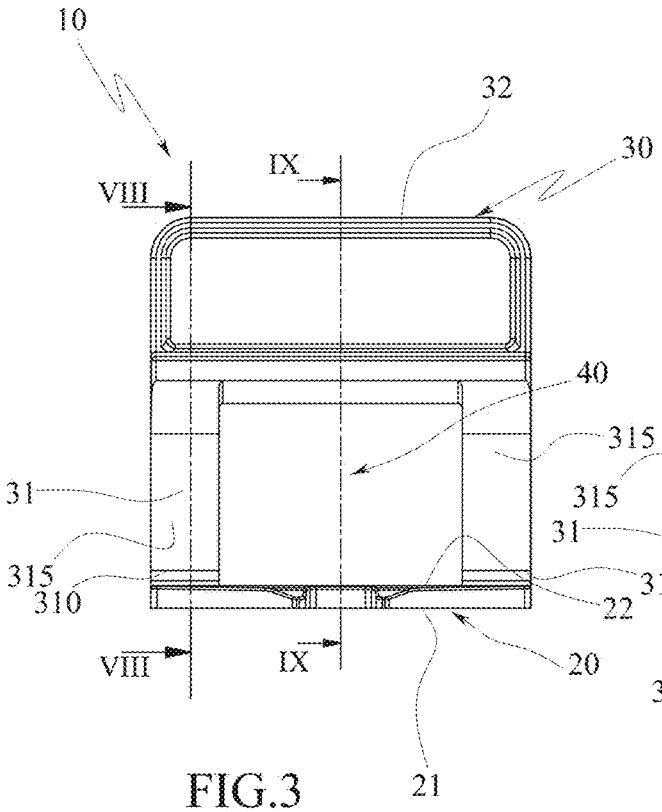
FIG. 3 is an anterior front view of FIG. 1.
Figure 4:
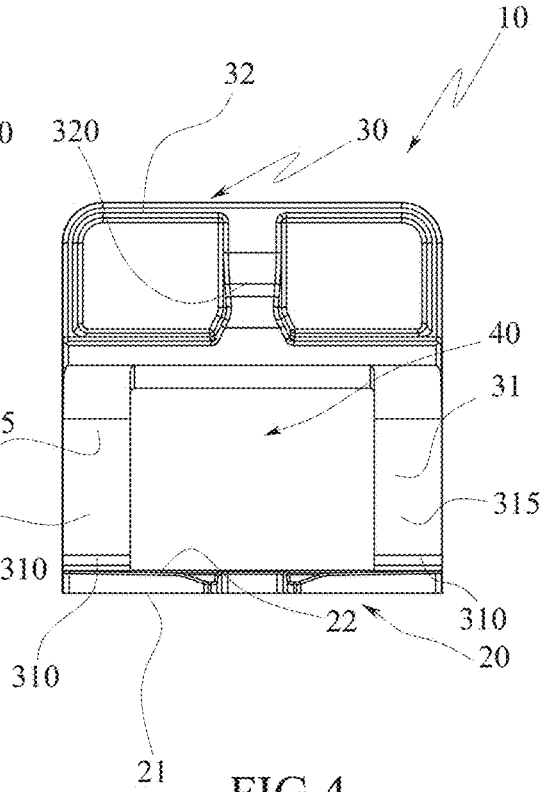
FIG. 4 is a rear front view of FIG. 1.
Figure 5:
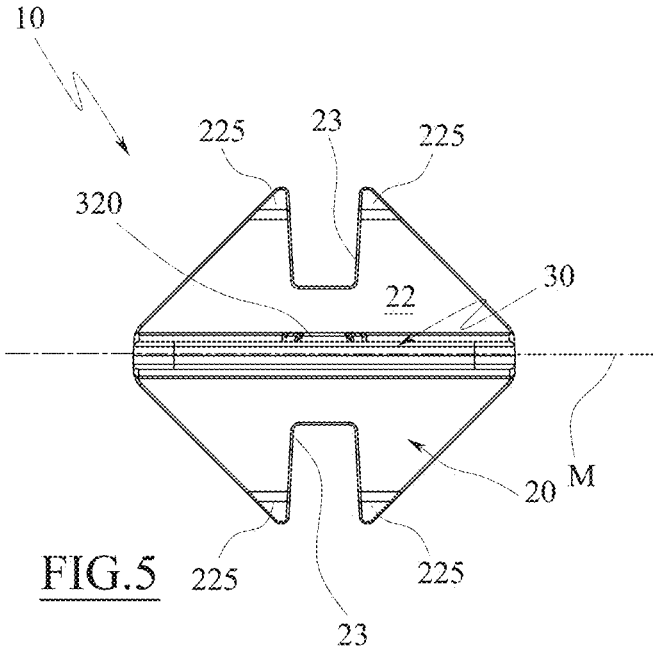
FIG. 5 is a plan view from above of FIG. 1.
Figure 6:
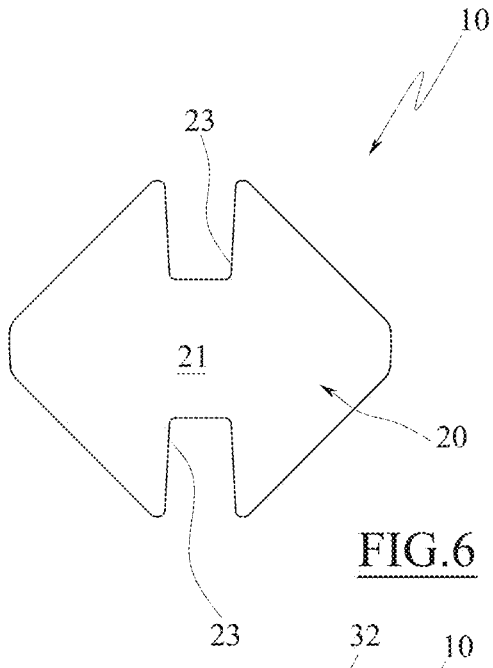
FIG. 6 is a plan view from the bottom of FIG. 1.
Figure 7:
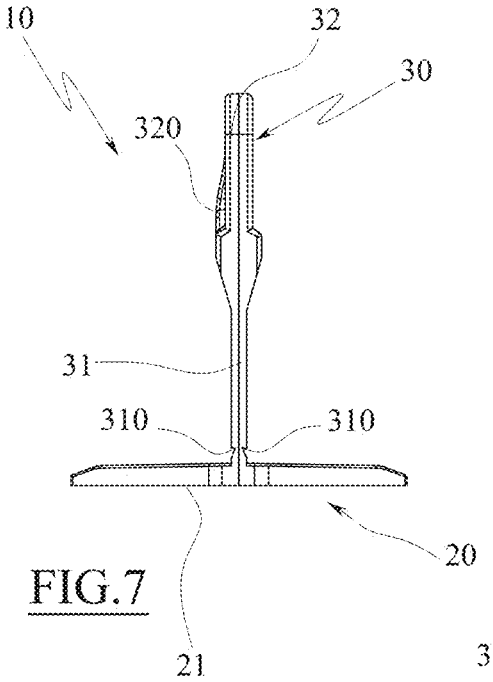
FIG. 7 is a side view of FIG. 1.
Figure 8:
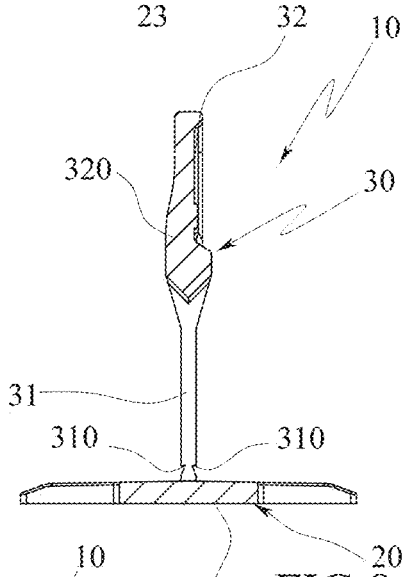
FIG. 8 is a sectional view along the trace of section VIII-VIII of FIG. 3.
Figure 9:
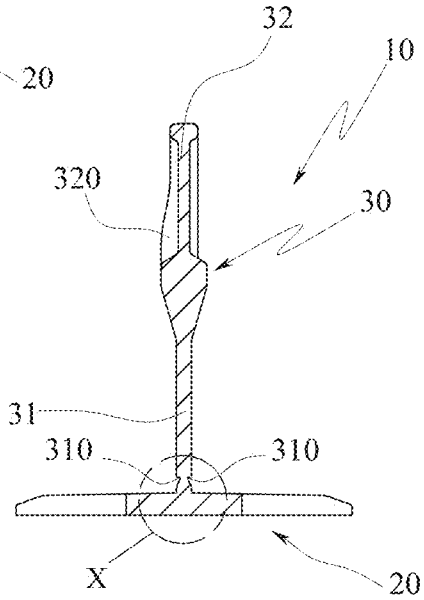
FIG. 9 is a sectional view along the trace of section IX-IX of FIG. 3.

With particular reference to these figures, the reference number 10 generally designates a levelling spacer device adapted to facilitate the laying slab-type products, such as tiles and the like, generally indicated with the letter P, and adapted to coat surfaces, i.e. flooring, walls, ceilings and the like.

The device 10 comprises a base 20 of enlarged shape, for example polygonal.

The base 20, in the example shown, is a monolithic body which has an irregular (plan) shape, for example substantially octagonal.

The base 20 comprises a lower surface 21, e.g. planar.

The lower surface 21 is adapted to rest on a layer of adhesive arranged on the screed which is intended to be coated by the tiles P.

The base 20 also comprises an upper surface indicated as a whole with number 22.

In the example, the upper surface 22 is (for most of its extension) planar (except for machining tolerances) and, for example, parallel to the upper surface 21.

It is not excluded that the upper surface 22 can be shaped in various ways as required.

The upper surface 22 (i.e. its main planar part) defines a support plane for at least two tiles P placed side by side (substantially parallel to the lower planar surface 21).

The support plane, i.e. the planar (highest) surface of the upper surface 22, is placed at a predefined distance d1 from the lower surface 21.

The support plane (i.e. the planar upper surface 22) is the surface of the base 20 that is the furthest from the lower surface 21.

In practice, the maximum thickness of the base 20 is defined by the first distance d1.

The base 20 (i.e., a perimeter portion of the upper surface 22 of the base 20) comprises a pair of tilted surfaces 225 that are opposite with respect to a median plane M of the base 20 orthogonal to the support plane defined by the upper surface 22. Each tilted surface 225 defines a ramp rising from the end of the base 20 towards the aforesaid median plane M in a direction that is orthogonal to the median plane M and which connects the lower surface 21 of the base 20 to the support plane (defined by the upper surface 22) of the base 20.

Each tilted surface 225 has a maximum distance from the lower surface 21 equal to the first distance d1 and a minimum distance from the lower surface 21 comprised between zero and a further distance, preferably equal to half of the first distance.

Each tilted surface 225 lies on a tilted plane at an acute (internal) angle with respect to the lower surface 21.

The base 20 comprises a pair of opposite eyelets 23 passing from the lower surface 21 to the upper surface 22, which are placed at a median plane of the base 20 orthogonal to the median plane M.

Each eyelet 23 has an elongated shape, i.e. it has a prevalent direction of development along a longitudinal axis orthogonal to the median plane M of the base 20.

Each eyelet 23 is open laterally at a respective end of the base 20 distal from the median plane M.

Each eyelet 23 defines a longitudinal through slit of the base 20 from the end that is distal from the median plane M towards it and with a prevalent direction orthogonal thereto.

The length of each eyelet 23 is lower than half the length of the base 20 in the direction orthogonal to the median plane M, e.g., it is comprised between 0.4 times and 0.55 times half the length of the base 20 in the direction orthogonal to the median plane M.

For example, each eyelet 23 is adapted to intersect a respective tilted surface 225 splitting this in two separate portions along a direction parallel to the median plane M and to the lower surface 21.

For example, each eyelet 23 has two opposite sidewalls facing each other, which are tilted towards each other and converge towards the median plane M of the base.

Again, each eyelet 23 has a closed end (opposite to the aforesaid open end, which forms a bottom wall substantially parallel to the median plane M (and which is connected to the sidewalls, for example by a respective rounded edge).

The device 10 comprises a spacer bridge 30 which, in use, is adapted to contact at least one portion of the facing sides of the at least two tiles P resting on the support plane of the upper surface 22 of the base 20.

The bridge 30 comprises two legs 31 each one rising from a lateral portion of the upper surface 22 of the base 20 in a direction orthogonal to the upper surface 22, that is to the support plane defined by the upper surface 22 of the base.

The legs 31 are placed side by side (at a non-zero distance from each other) along a flanking direction parallel to the median plane M and parallel to (the support plane defined by) the upper surface 22 of the base 20.

The bridge 30 then comprises a crosspiece 32 which joins the top of the two legs 31 and is arranged with a longitudinal axis parallel (to the flanking direction between the legs 31) and at a distance (not zero) from the upper surface 22 of the base 20.

The bridge 30 is for example made as a single body with the base 20, for example by injection moulding of plastic material.

The bridge 30 is defined globally by a slab-shaped body arranged parallel to the median plane M of the base 20, so that the median plane M of the base 20 is also a median plane at least of the legs 31 (i.e. of each leg 31) thereof.

The bridge 30 (as a whole) has a width, meaning by width the dimension parallel to the median plane M (which cuts both legs 31), equal to the base width 20 in the same direction.

Each leg 31 of the bridge 30 has a lower end fixed to (and deriving from) the upper surface 22 of the base 20.

Each leg 31 of the bridge 30 is frangibly connected to the upper surface 22 of the base 20 by a predefined fracture line 310.

The fracture line 310 is parallel to the upper surface 22, i.e., to the support plane defined by it, and to the median plane M (i.e., parallel to the flanking direction of the legs 31) and is placed at a second distance d2 from the lower surface 21, wherein the second distance d2 is preferably greater than the first distance d1 (e.g., equal to twice the first distance d1).

Each leg 31 of the bridge 30 is substantially slab-shaped and has a longitudinal axis (prevalent direction) orthogonal to (the support plane of) the upper surface 22 from which it derives.

Each leg 31 has a height (in a direction parallel to the longitudinal axis thereof) greater than the thickness of the tiles P to be placed side by side, so that the crosspiece 32 of the bridge 30 is always at a level (distance from the lower surface 21) greater than the level of the surface, in view, of the tiles P to be placed side by side. Each leg 31 has a width, meaning by width the dimension parallel (to the support plane e) to the median plane M (which cuts both legs 31), lower than the width of the base 20 in the same direction, for example lower than ¼ of the width of base 20.

For example, each leg 31 has a pair of opposite sides that laterally delimit the leg 31.

More specifically, each leg 31 comprises an inner side provided with a top end that joins (directly) to the crosspiece 32 and an opposite base end that for example joins at the upper surface 22 of the base 20.

The inner side of each leg 31 faces the inner side of the other leg 31 and is placed at a predetermined (non-zero) distance therefrom in the flanking direction of the legs 31.

Each leg 31 has a thickness (meaning by thickness the direction orthogonal to the median plane M) which may be variable (e.g. in sections) along its longitudinal axis.

Each leg 31 comprises a central sector axially interposed between the crosspiece 32 and the lower end of the leg 31, wherein the central sector is provided with two opposite sidewalls 315 with respect to the median plane M and parallel to each other.

The sidewalls 315 of the central sector are the zone of the leg 31 which substantially comes into contact with the side-by-side tiles P resting on the support plane of the upper surface 22 of the base 20 substantially defining the mutual distance in a direction orthogonal to the median plane M.

In practice, the sidewalls 315 are placed at a predefined calibrated mutual distance (equal for both legs 31), for example equal to 1 mm, 1.5 mm, 2 mm or multiples of 0.5 mm.

The distance between the sidewalls 315 defines the width of the joint (interspace) between the tiles P.

Each leg 31 then comprises a block adapted to interconnect the central sector with the upper surface of the base 20.

The block has a thickness, i.e. a transverse section made with respect to a plane orthogonal to the median plane M, which is smaller than the mutual distance between the two sidewalls 315 of the central sector.

The block has an upper end connected to the central sector and a lower end, which coincides with the lower end of the leg 31 as a whole, directly connected to the upper surface 22 of the base 20.

The fracture line 310 is defined at the block, in an intermediate zone thereof, e.g. proximal to (or at) the upper end of the block.

In the example, the fracture line 310 delimits at the top (i.e. on the opposite side of the upper surface 22) the block of the respective leg 31.

Figure 10:
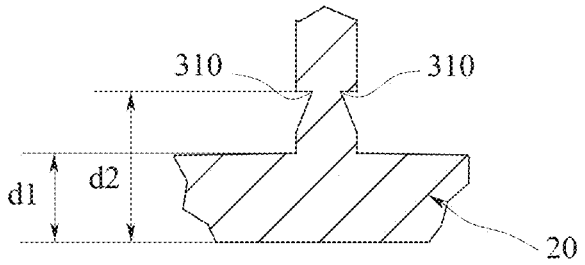
FIG. 10 is an enlargement of detail X of FIG. 9.

The fracture line 310, as shown in the detail of FIG. 10, is defined (and constituted) by a longitudinal cut defining the zone having the smallest transverse section (in any direction and in particular in the direction orthogonal to the median plane M) of the entire leg 31.

The longitudinal cut defining the fracture line 310 defines the trigger zone of the fracture of the bridge 30 with respect to the base 20.

The longitudinal cut has a longitudinal axis parallel to (the support plane defined by) the upper surface 22 and to the median plane M (i.e., parallel to the flanking direction of the legs 31) and is full length, i.e., occupies the entire width of the leg 31 (i.e., of the block).

The longitudinal cut has a constant transverse section (i.e. with respect to a plane orthogonal to the median plane M) along its entire length.

Advantageously, the longitudinal cut has a transverse section having a substantially "V" shape, e.g. asymmetrical, with concavity facing on the opposite side with respect to the median plane M.

For example, the longitudinal cut has an upper side, e.g. orthogonal to the median plane M and parallel to (the support plane of) the upper surface 22, and a lower side tilted at an angle, preferably acute, with respect to the upper side and incident with respect to the upper side at a vertex (pointed or sharp-edged), which defines the minimum section of the leg 31 and, therefore, the trigger zone of the fracture of the bridge 30 with respect to the base 20.

Each leg 31, i.e. each block, comprises a pair of identical fracture lines 310, i.e. longitudinal cuts, symmetrically arranged with respect to the median plane M of the bridge 30 (and of the base 20).

In practice, the minimum section of the leg 31, which triggers the fracture of the bridge 30), is defined at the joining plane (orthogonal to the median plane and parallel to the support plane defined by the upper surface 22) of the vertices of the longitudinal cuts that define the fracture line 310.

Each leg 31, further, comprise a top connecting sector, which is configured to join the leg 31 (i.e. the top of the central sector) to the crosspiece 32.

The top connecting sector has, for example, a greater thickness (overall) than the thickness of the central sector, for example increasing (steadily) from its lower end (joined to the upper end of the central sector) to its upper end defining the top end of the leg 31 (and joining the crosspiece 32).

Coming back then to the overall shape of the leg 31, the crosspiece 32, which as said above extends longitudinally with the longitudinal axis thereof parallel to the flanking direction of the legs 31, comprises a transverse section (with respect to a plane orthogonal to the median plane M and orthogonal to this flanking direction) defining a thicker zone in a zone proximal to the top end of the legs 31 and with full longitudinal development.

This thicker zone defines a reinforcing beam for the bridge 30.

This thicker zone is surmounted at the top by a thinner gripping portion and is connected to the legs 31 by means of tilted connecting surfaces.

The reinforcing beam, in the zone interposed between the legs 31, i.e. superimposed on a central portion 220 of the upper surface 22 of the base 20, ends up at the bottom with a shaped edge, for example "V"-shaped.

The distance of the shaped edge from the underlying (central portion 220) of the upper surface 22 of the base 20 is (abundantly) greater than the thickness of the tiles P to be laid.

The shaped edge is lengthened axially from (and has substantially the same transverse section as) the top connecting sector of the legs 31.

The crosspiece 32, moreover, has a longitudinal development (length) that is lower than or equal to the maximum distance between the outer sides of the legs 31.

In the example, the crosspiece 32 has a perimeter frame with increased thickness, which is substantially C-shaped and delimits the crosspiece at the top and laterally, being closed at the bottom on the top connecting sector of the legs 31.

In practice, the top connecting sector of the legs 31 and the shaped edge of the crosspiece 32 close the perimeter frame at the bottom, defining an annular (reinforced) frame.

The thickness of the inner part of the crosspiece 32 inside the perimeter frame (and the boundary defined by the sector of the top connection of the legs and by the shaped edge) can be reduced with respect to the thickness of the perimeter frame. Advantageously, the crosspiece 32 has an asymmetrical shape with respect to the median plane M (and symmetrical with respect to a median plane orthogonal to the median plane M).

Preferably, on one (only) face of the crosspiece 32 there is a central beam 320 with a longitudinal axis orthogonal to the (support plane defined by) the upper surface 22 of the base 20, which preferably extends throughout the entire height of the crosspiece (from the upper portion of the perimeter frame to the shaped edge).

In practice, the central beam 320 splits the inner part of the crosspiece 32 (with smaller thickness) in two lightening sub-windows.

For example, the central beam 320 has a thickness (meaning by thickness the dimension orthogonal to the median axis M) which varies along its longitudinal development, for example increasing from the upper zone (which connects with the upper portion of the perimeter frame) to the lower zone (which connects with the shaped edge).

The central beam 320 (present only on one side of the crosspiece) defines the only asymmetry element of the crosspiece 32 (and of the bridge 30) with respect to the median plane M.

For example, at least a portion of the central beam 320 is at (or otherwise aligned along an alignment axis orthogonal to the median plane M of the base 20 and/or the bridge 30) with an injection point (of the plastic in the cavity of the mould which is used to form the base 20 and the bridge 30).

The injection point (generally visible in the finished product as defined by a slight indentation) is usually a weakened point of the product.

The central beam 320 (due to its shape and position) defines a reinforcement at this injection point that prevents any accidental breakages of the bridge 30 at unintended points (of the crosspiece 32).

The other face of the crosspiece 32 (is instead not provided with the central beam 320 *e*) has a single undivided inner part (with smaller thickness).

It is not excluded that the inner part(s) of the crosspiece may be defined by a zone with zero thickness, i.e. defining a through hole in the thickness of the crosspiece with a through axis orthogonal to the median plane M.

In one embodiment shown in FIGS. 1-9, the central portion 220 of the upper surface 22 that is aligned along an alignment axis orthogonal to (the support plane defined by) the upper surface 22 is placed at the same level as the support plane defined by the upper surface 22, i.e. it is free of reliefs or barriers (so-called "fence").

In practice, the two sub-portions of the upper surface 22 of the base 20 that are on opposite sides with respect to the (bridge 30 and the) median plane M are communicating with each other without any barrier or raised portion or step of the base 20, i.e., they are both coplanar and joined together coplanarly (or without any height differences/steps or barriers) by the central portion 220 of the upper surface 22 that is aligned along an alignment axis orthogonal to the (support plane defined by) the upper surface 22.

In such a case, the central portion 220 of the upper surface 22 (which is below the projection of the crosspiece 32, in a plan view along a direction orthogonal to the support plane) has a length substantially equal to the length of the shaped edge (V-shaped) of the crosspiece 32 facing the support plane.

This central portion 220 of the upper surface 22 (coplanar with the support plane), in practice, extends up to the lower ends of the inner side of the legs 31, which lie (completely) on planes orthogonal to the support plane and the median plane M. In further and preferred embodiments shown in FIGS. 13-24, each leg 31 (and/or the base 20) has a respective connecting foot 311 protruding from an inner side of the respective leg 31 towards the other leg 31.

Said connecting feet 311 are separated from each other by an interspace (gap). Preferably, each connecting foot 311 is derived from the (only) block of the respective leg 31 below the crosspiece 32 (i.e. aligned in plan along a direction orthogonal to the support plane to a portion of the shaped edge of the crosspiece).

In practice, each connecting foot 311 is located under a respective lateral portion of the projection of the crosspiece 32, in a plan view along a direction orthogonal to the support plane towards the base 20.

Each connecting foot 311 has:

- a bottom (or bottom wall) joined to (and deriving from) the upper surface of the base (and deriving therefrom as a single body),
- a proximal lateral end (to the respective leg 31) that is joined to the respective leg (and deriving therefrom),
- a free distal lateral end (from the respective leg from which derives) which is separated from the distal end of the other connecting foot 311, and and a top wall facing towards the crosspiece 32.

The proximal lateral end is, de facto, joined to the inner side of the respective leg 31, in particular to the portion of the inner side delimiting the (only) block.

The top wall of each connecting foot 311 is raised with respect to the support plane and has a maximum distance from the lower surface 21 of the base that is lower than or equal to the second distance d2 (i.e. it is raised from the support plane by a height that does not exceed the height at which the fracture line 310 is located). Preferably, the top walls of the connecting feet 311 are tilted at respective opposite (equal) acute angles with respect to the support plane.

The top wall of each connecting foot 311 thus defines a ramp rising from the distal lateral end to the proximal lateral end of the respective connecting foot 311 (which, as will be better described below, connects/joins the support plane with the fracture line 310).

In other words, each connecting foot 311 has a substantially triangular or trapezoidal shape when viewed along a direction parallel to the support plane and orthogonal to the median plane M.

Preferably, each connecting foot 311 substantially has the shape of a right-angled triangle or a right-angled trapezoid, wherein the right angle is defined between the bottom and the proximal end.

In addition, the distal lateral end of each connecting foot 311 may be wider than the proximal lateral end.

For example, the top (and/or the bottom) wall has a substantially trapezoidal (isosceles) shape, wherein the major base is defined by the distal lateral end, the minor base is defined at the proximal lateral end, and the two oblique sides define the corners between the top (and/or the bottom) wall and two opposite sidewalls of the connecting foot (triangular and/or trapezoidal in shape).

Advantageously, the distal lateral end is placed at a minimum distance from the lower surface 21 of the base 20, wherein the minimum distance is greater than or equal to the first distance d1, preferably equal to the first distance d1 (i.e. coplanar with and concealed in the support plane).

The proximal lateral end is placed at the said maximum distance from the lower surface 21 of the base 20, wherein the maximum distance is lower than or equal to the second distance d2, preferably equal to the second distance d2 (i.e. so as to join an inner axial end of the fracture line 310).

In general, the minimum distance at which the distal lateral end is located is lower than the maximum distance at which the proximal lateral end is located.

In practice, in the examples illustrated, each connecting foot 311 has a triangular shape, of a right-angled triangle, in which the hypotenuse is defined by the top wall, one cathetus (major) is defined by the bottom and another cathetus (minor) is defined by the proximal lateral end (while the distal lateral end is defined by the vertex between the bottom and the top wall).

Each connecting leg 311 has a thickness (i.e. a dimension orthogonal to the median plane M) lower than or equal to the thickness of the respective leg 31, preferably lower than or equal to the thickness of the block from which it derives).

For example, the top wall of each connecting foot 311 is either planar (i.e., lies on a plane tilted at an acute angle, preferably lower than 45°, to the support plane) or arched (preferably along an arc of circumference), e.g., concave (with concavity facing the crosspiece) or convex.

Each connecting foot 311 has a prevalent longitudinal development given by the distance between the proximal lateral end and the distal lateral end (i.e., equal to the length of the bottom thereof), which is, for example, lower than half the distance between the inner sides of the legs 31 (at the central sector thereof).

For example, the distal lateral ends of the two connecting feet 311 are distant from each other by a non-zero distance, which is greater than a thickness of the leg 31, i.e., the distance between the sidewalls 315 thereof.

In the examples illustrated, each connecting foot 311 has a prevalent longitudinal development lower than the width of the leg 31 (i.e. substantially equal to half the width of the leg 31, as shown in FIGS. 13-18 or comprised between half the width of the leg 31 and the maximum width of the leg 31, as shown in FIGS. 19-24). The distal lateral ends of the two connecting feet 311 (separated by the said interspace) are distant from each other by a distance greater than the width of each leg 31.

However, it is not excluded that each connecting foot 311 may have a prevalent longitudinal development greater than or equal to the width of the leg 31.

In such a case, for example, the distal lateral ends of the two connecting feet 311 may be spaced apart by a distance lower than the width of each leg 31, for example substantially equal to half the width of each leg 31.

In any case, in such embodiment, the central portion 220 of the upper surface 22 of the base 20 (which is coplanar to the support plane defined by the upper surface of the base and which is below the projection of the crosspiece 32, in a plan view along a direction orthogonal to the support plane) extends longitudinally between the distal ends of the two connecting feet 311 and is lengthened axially (on both sides) by the two rising ramps (towards the predetermined fracture lines 310 of the legs 31) defined by the top walls of the connecting feet 311.

The length of the central portion 220 of the upper surface 22 of the base 20 is equal to the distance between the distal lateral ends of the connecting feet 311 (i.e., the minimum width of the aforesaid interspace between the connecting feet 311).

Advantageously, the central portion 220 of the upper surface 22 (which is aligned in plan with the central portion 220 of the crosspiece 32 interposed between the lateral portions thereof) extends longitudinally between the two legs 31 (i.e. between the two distal lateral ends of the connecting feet 311 thereof) over a length lower than a length of the shaped edge of the crosspiece 32 facing towards the upper surface 22 of the base 20 and extends longitudinally between the top of the two legs 31. In such embodiments, shown in FIGS. 13-24, the central portion 220 of the upper surface 22 that is aligned along an alignment axis orthogonal to (the support plane defined by) the upper surface 22 is placed at the same level as the support plane defined by the upper surface 22, i.e. it is free of reliefs or barriers (so-called "fence").

In practice, the two sub-portions of the upper surface 22 of the base 20 that are located on opposite sides with respect to the (bridge 30, the connecting feet 311 and the) median plane M are communicating with each other without any barrier or raised portion or step of the base 20, i.e., they are both coplanar and joined together coplanarly (or without height differences/gradients or barriers) by the central portion 220 of the upper surface 22 that is aligned along an alignment axis orthogonal to the (support plane defined by) the upper surface 22.

The bridge 30, with its portal shape described above, and the base 20 joined thereto altogether define a through opening 40 which crosses the bridge 30 and the base 20 in a direction orthogonal to the median plane M of the base 20.

The through opening 40 is peripherally delimited by the crosspiece 32 and the legs 31 (as well as by the connecting feet 311 where provided) of the bridge 30 and by the central portion 220 of the upper surface 22 (planar and without steps/barriers or "fence") of the base 20.

More in detail, the through opening 40 is delimited at the top by the shaped edge (of the reinforcing beam) of the crosspiece 32, at the bottom of the central portion 220 of the upper surface 22 (coplanar with the support plane defined by the upper surface 22) of the base (i.e. the zone of the same subtended by the crosspiece 32) and, where provided, by the top wall of the connecting feet 311, and laterally by the facing internal sides of the legs 31.

The through hole 40 overall has a substantially rectangular shape (regular or nonregular, when the connecting feet 311 are provided).

The through opening 40 has a through axis orthogonal to the median plane M of the base 20.

The base 20, the bridge 30 and the through hole 40 define a first body or a base of the device 10.

Figure 11:
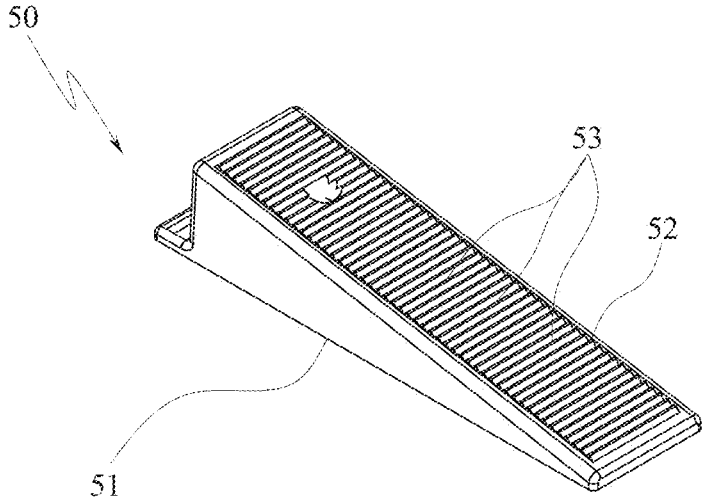
FIG. 11 is an axonometric view of a pressure wedge of a levelling spacer device, according to the invention.
Figure 12:
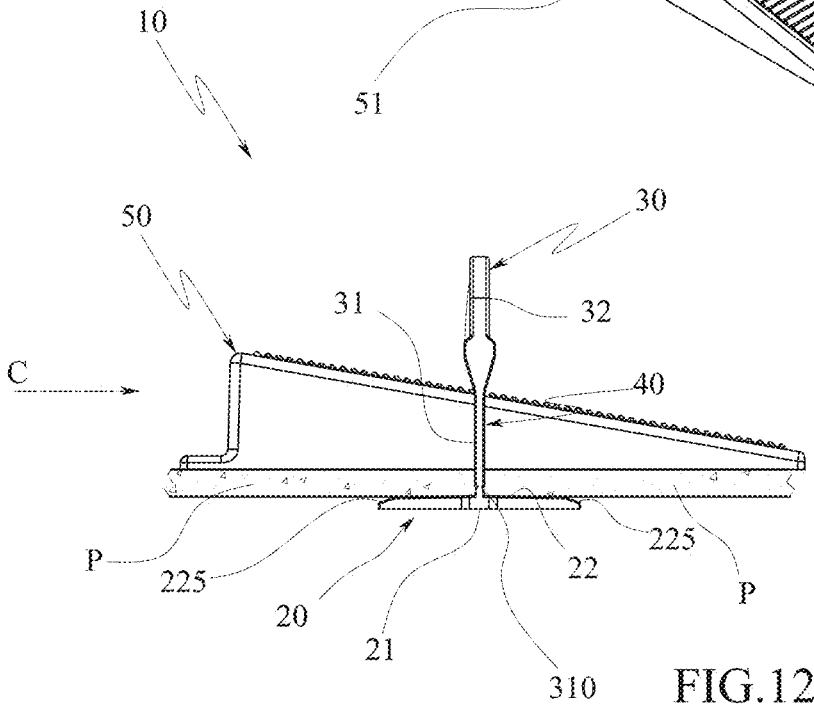
FIG. 12 is a side view of a levelling spacer device in operating configuration.
Figure 13:
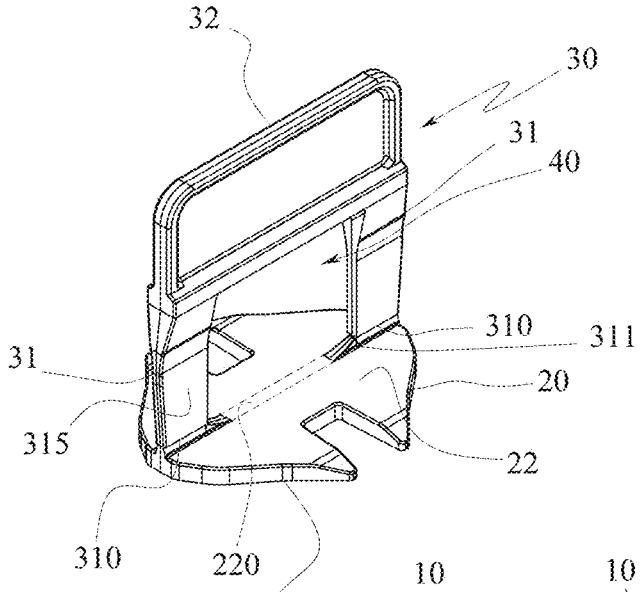
FIG. 13 is an axonometric (front) view of a levelling spacer device, according to a second embodiment of the invention.
Figure 14:
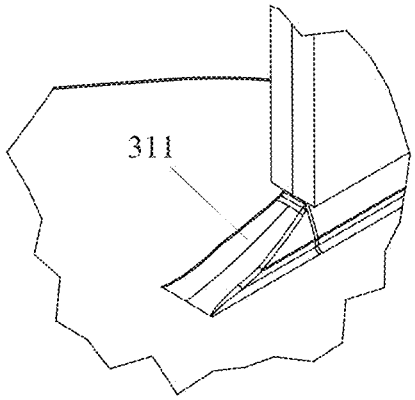
FIG. 14 is a view of a detail of FIG. 13.
Figure 15:
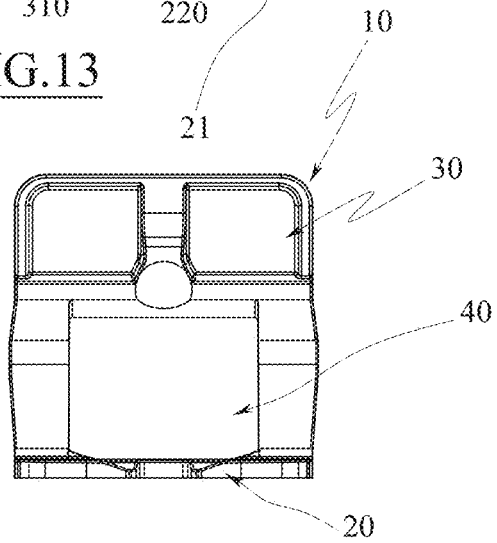
FIG. 15 is a rear front view of FIG. 13.
Figure 17:
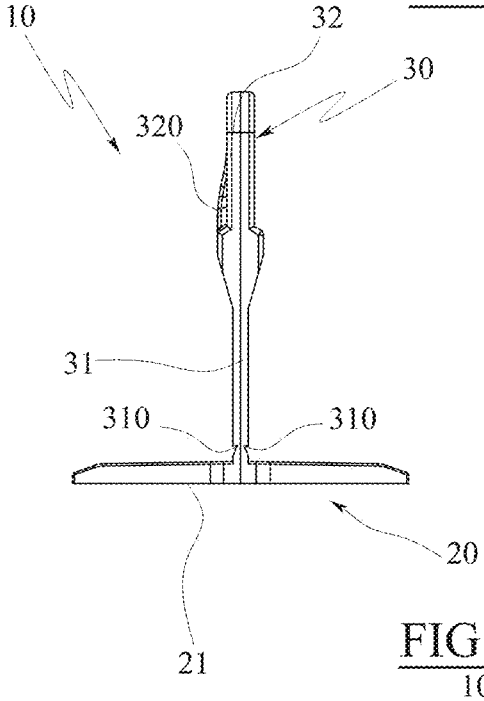
FIG. 17 is a side view of FIG. 13.
Figure 16:
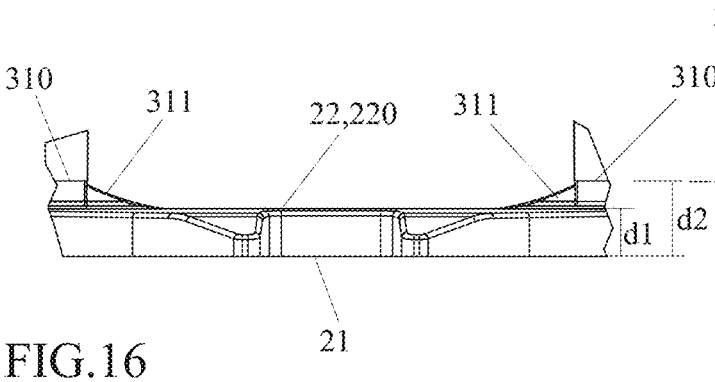
FIG. 16 is a view of a detail of FIG. 15.
Figure 18:
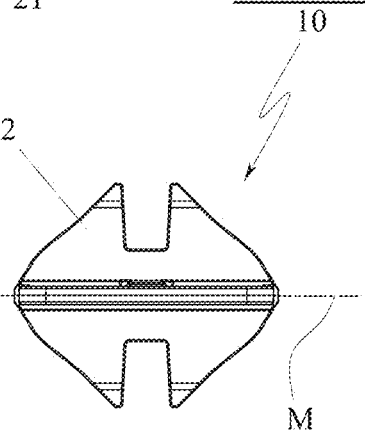
FIG. 18 is a plan view from above of FIG. 13.
Figure 19:
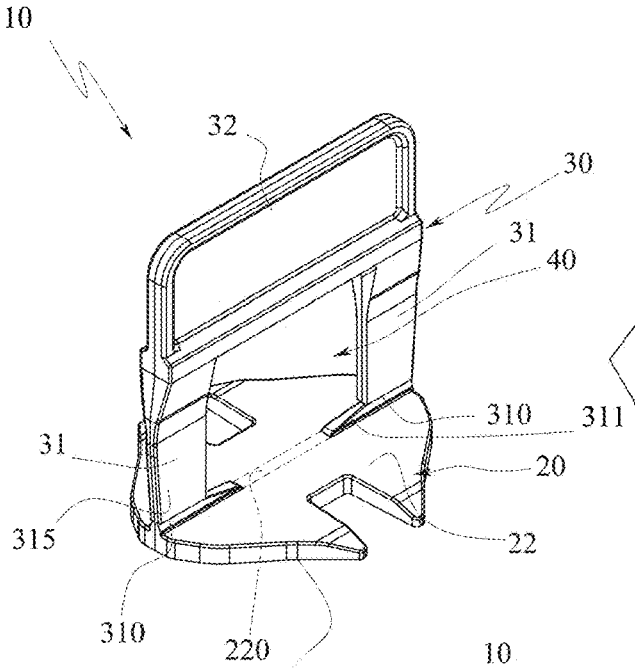
FIG. 19 is an axonometric (front) view of a levelling spacer device, according to a third embodiment of the invention.
Figure 20:
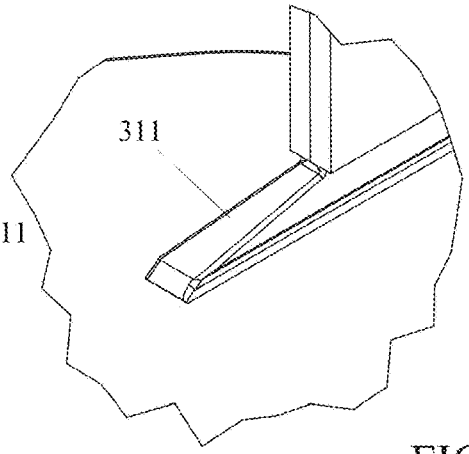
FIG. 20 is a view of a detail of FIG. 19.
Figure 21:
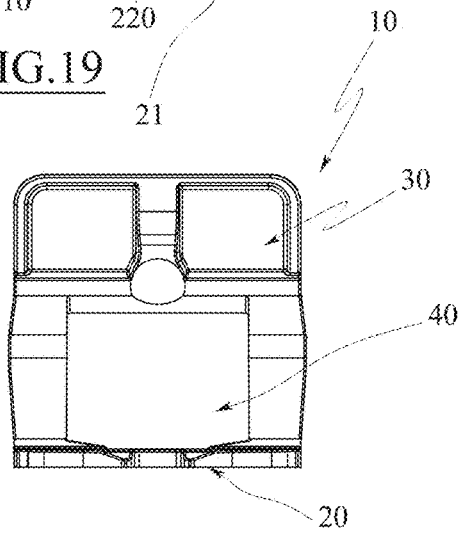
FIG. 21 is a rear front view of FIG. 19.
Figure 23:
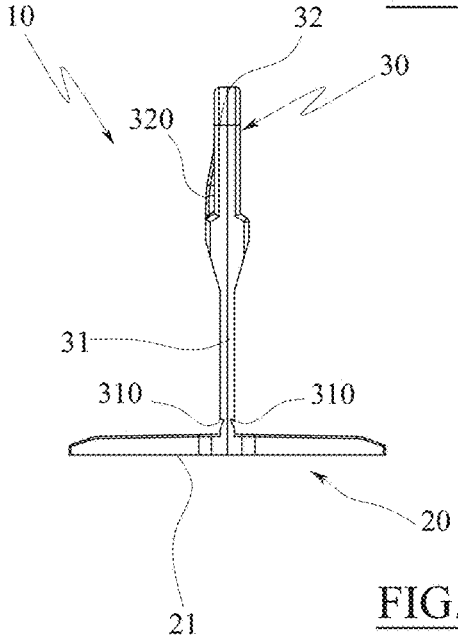
FIG. 23 is a side view of FIG. 19.
Figure 22:
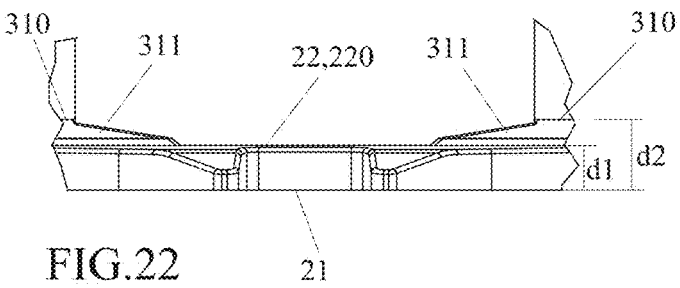
FIG. 22 is a view of a detail of FIG. 21.
Figure 24:
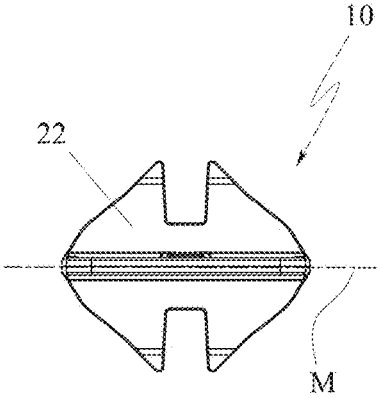
FIG. 24 is a plan view from above of FIG. 19.
Figure 25A:
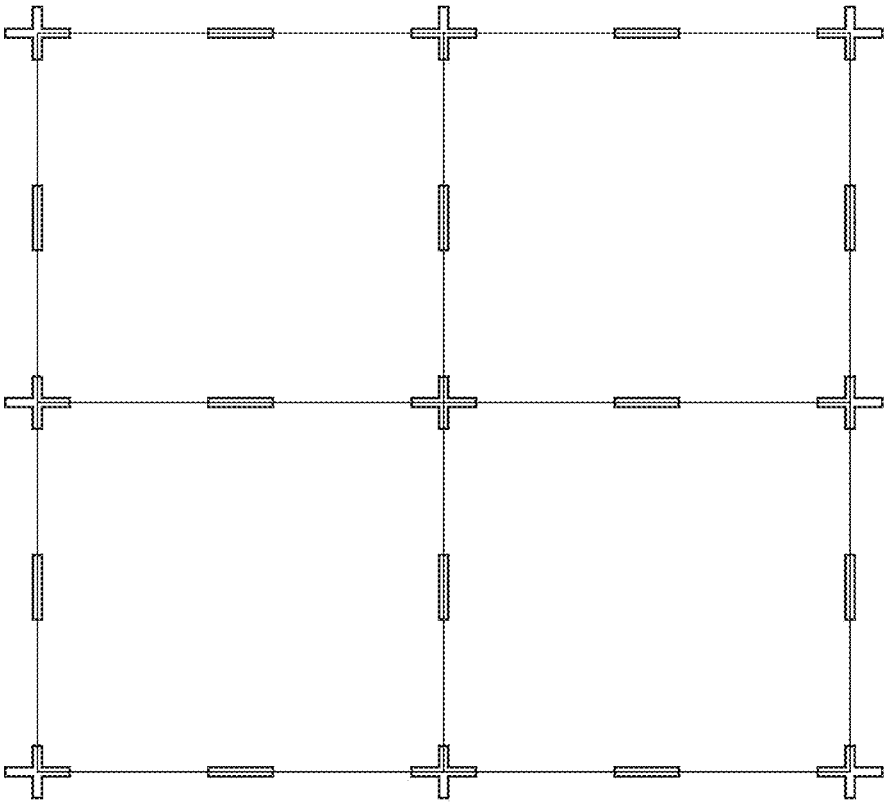
FIG. 25*a* is a schematic plan view of a first possible tile laying scheme, so-called "straight".
Figure 25B:
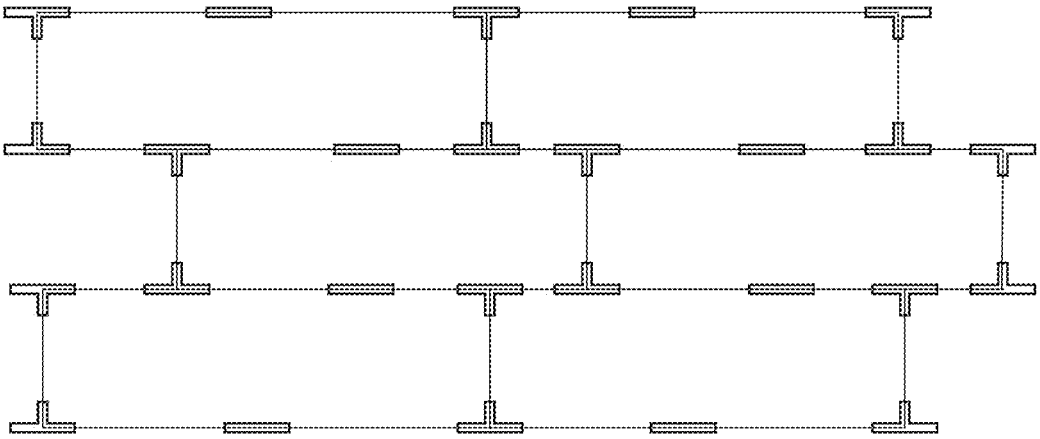
FIG. 25*b* is a schematic plan view of a second possible tile laying scheme, so-called "staggered".
Figure 25C:
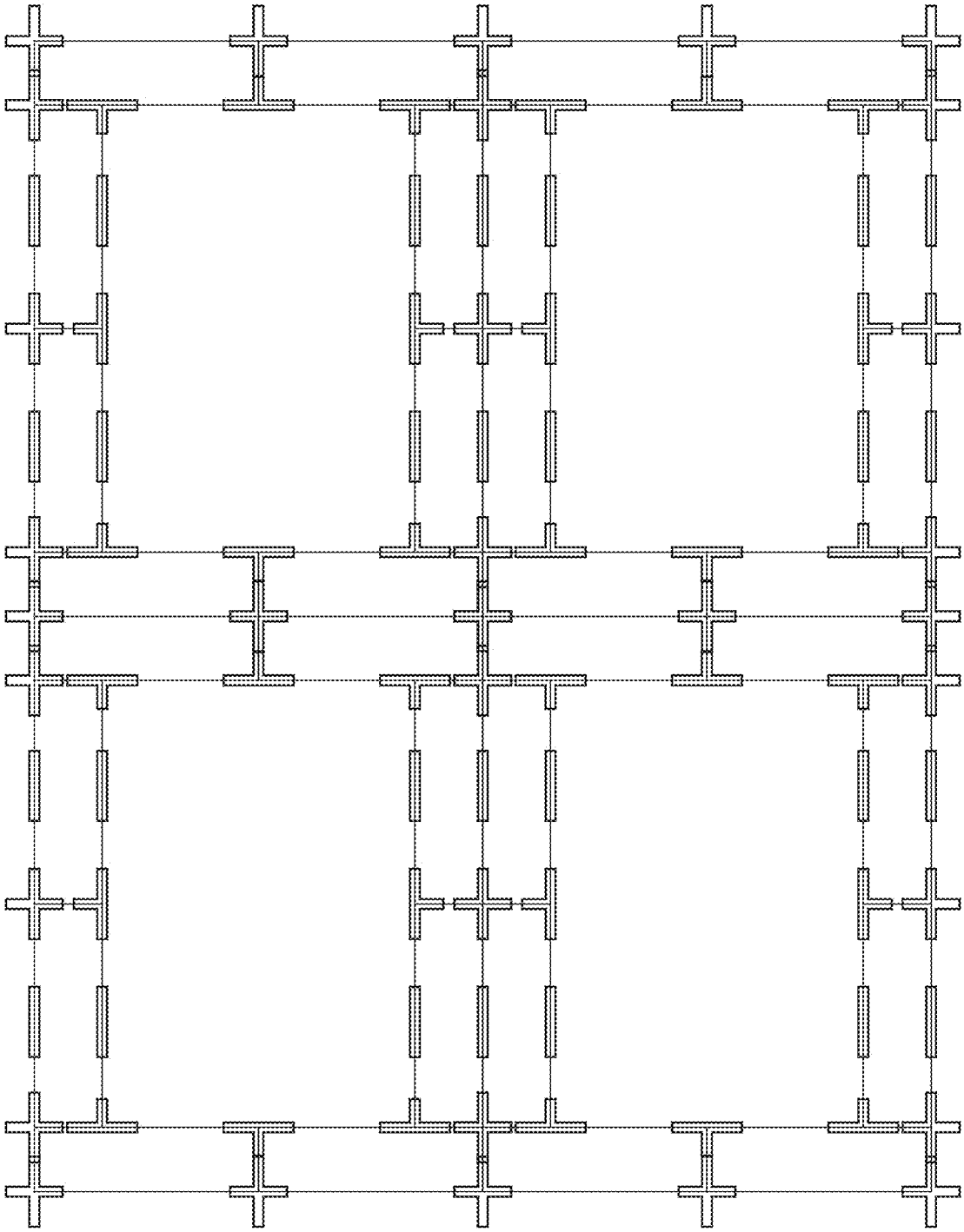
FIG. 25*c* is a schematic plan view of a third possible tile laying scheme, so-called "complex".

The device 10 further comprises a pressure wedge 50, separated from the base 20 and from the bridge 30 (see FIGS. 11 and 12).

The pressure wedge 50 is a right-angled wedge, for example it is provided with a lower flat surface 51 and adapted to be arranged, in use, parallel to the support plane defined by the upper surface 22 of the base 20 and an upper surface 52 tilted with respect to the lower surface 51 and provided with abutment elements, such as teeth 53 or knurls.

The pressure wedge 50 then comprises two parallel lateral sidewalls.

The pressure wedge 50 has variable (and steadily growing) thickness along its longitudinal axis from a tapered end towards the opposite widened end.

The pressure wedge 50 is configured so that it can be axially fitted with clearance through the through opening 40 defined between the base 20 and the bridge 30 of the device 10 along a crossing direction C (see FIG. 12) which is orthogonal to the aforesaid median plane M of the bridge 30 and of the base 20.

For example, the maximum height of the pressure wedge 50 (maximum distance between the lower surface 51 thereof and the upper surface 52 thereof) is lower than the height of the through opening 40 defined by the distance between the crosspiece 32 (i.e. the shaped edge thereof) and the upper surface 22 of the base 20 (i.e. the central portion thereof 220 coplanar with the support plane of the upper surface 22).

The shaped edge of the crosspiece 32 is adapted to engage the teeth 53 substantially like a pop-up during the translation inside the through opening 40 along the crossing direction C.

The width of the pressure wedge 50 is substantially equal to (or slightly lower than) the distance between the two legs 31 (i.e. between the two facing inner sides thereof).

The pressure wedge 50 is adapted to be fitted inside the through opening 40 and to slide, with the lower surface 51 resting on the surfaces, in view, of the tiles P resting on the support plane 211 defined by the upper surface 22 of the base 20, in such a way that the upper surface 52 of the pressure wedge 50 comes into forced contact with the shaped edge of the crosspiece 32 and the same pressure wedge 50 is thus pressed against both tiles P, placed on opposite sides with respect to the bridge 30, due to the thrust thereof towards the base 20 and the levelling thereof.

In light of the above, the operation of the device 10 is as follows.

The device 10 allows the laying of tiles P according to different laying schemes as illustrated in FIGS. 13*a*-13*c*.

In order to coat a surface with a plurality of tiles P, it is sufficient to spread a layer of adhesive over it and, subsequently, it is possible to lay the tiles P.

In practice, where the first tile is to be arranged, it is sufficient to position a first device 10, whose base 20 is intended, for example, to be placed under four corners of respective two/four tiles P.

Once the base 20 has been positioned, it is sufficient to position the two/four tiles P so that each of them has a portion of the lateral side in contact respectively with a sidewall 315 of one or both legs 31.

In this way, the equidistance between the two/four tiles P that surround the bridge 30 and are resting on the support plane of the base 20 is ensured.

When for example the tiles P have particularly large dimensions, then it is possible to position a device 10 also at a median zone of the lateral side of the tile.

In doing so, the tile P rests on one or more support planes defined by the upper surface 22 of respective bases 20.

Generally, the work is done by first laying a tile P and subsequently at a corner or a side thereof, a base portion 20 of the device 10 is inserted thereunder.

In this circumstance, the tilted surfaces 225 and, for example, the eyelets 23 (slightly flared) play an important role in facilitating (jointly) the wedging of the base 20 below the laying surface of the tile P while still allowing the adhesive not to be scraped completely off the laying surface.

Once the various bases 20 have been positioned with their respective bridges 30 which stand above the surfaces in view of the side-by-side tiles P as described above, until the adhesive has still not completely solidified, it is proceeded with the insertion of the various pressure wedges 50 inside each through opening 40, which, by pressing on the surfaces in view of the tiles P, locally at the various (median or corner) points, allow the perfect levelling of the surfaces in view of the same tiles. Finally, when the adhesive has hardened and set, it is proceeded with breaking the long bridge 30, causing, for example by means of an impulsive force directed parallel to the median plane M, the trigger of the fracture along the fracture line 310 of each leg 31 and thus removing the same bridge 30 (single-use) and the pressure wedge 50 (reusable) so as to be able to fill the joints between the tiles P without the base 20 (and any portion thereof) being visible on the finished surface and/or no part of the base 20 being interposed between the tiles.

The connecting feet 311, where the breakage of the bridge 30 is made in a condition in which the adhesive has not completely hardened, ensure that the breakage of the bridge 30 with respect to the base 20 takes place precisely on the plane defined by the fracture line 310.

The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. A levelling spacer device for the laying of slab-shaped products for coating surfaces, comprising:

at least a base (having a lower surface and an opposite upper surface defining a support plane for at least two slab-shaped products placed side by side, wherein the support plane defined by the upper surface is placed at a first distance from the lower surface;

a spacer bridge provided with:

two legs placed side by side between each other along a flanking direction and each one rising from a respective portion of the upper portion of the base in a direction orthogonal to the support plane, wherein each leg is frangibly connected to the respective base portion by a predefined fracture line placed at a second distance from the lower surface greater than the first distance, wherein the fracture line is formed by a longitudinal cut with a longitudinal axis that is parallel to the flanking direction; and a crosspiece, which joins the top of the two legs along the flanking direction; and a through opening adapted to be crossed by a pressure wedge along a crossing direction orthogonal to the flanking direction, where-in the through opening is peripherally delimited at the top by the crosspiece of the bridge, laterally by the legs of the bridge and at the bottom by a central portion of the upper surface of the base coplanar with the support plane;

wherein each leg has a respective connecting foot protruding from an inner side of the respective leg projecting into the through opening, wherein each connecting foot has a bottom joined to the upper surface of the base, a proximal lateral end joined to the respective leg, a free distal end separated from the distal end of the other connecting foot and a top wall facing the crosspiece, wherein the top wall of each connecting foot has a maximum distance from the lower surface of the base lower than or equal to the second distance and is tilted at an acute angle to the support plane so as to define a ramp rising from the distal end to the proximal end.

2. The device according to claim 1, wherein the longitudinal cut which forms the fracture line extends throughout an entire width of the respective leg.

3. The device according to claim 1, wherein the crosspiece is asymmetrical relative to the median plane of the base that is orthogonal to the crossing direction.

4. The device according to claim 1, wherein the base comprises a pair of opposite eyelets passing from the lower surface to the upper surface that are open at the opposite distal ends by a median plane of the base orthogonal to the crossing direction, each eyelet having lateral sides converging between each other towards the median plane.

5. The device according to claim 1, wherein the upper surface comprises a pair of opposite surfaces tilted at the base ends distal from the bridge and opposite thereto, wherein each tilted surface defines a ramp rising from the base end towards the bridge, in a direction parallel to the crossing direction, and which connects the lower surface of the base to the support plane defined by the upper surface of the base.

6. The device according to claim 4, wherein each eyelet cuts a respective tilted surface splitting the respective tilted surface in two.

7. The device according to claim 1, wherein the upper surface of the base is planar, the support plane defined by the upper surface extending over most of the upper surface.

8. The device according to claim 1, wherein the distal end is placed at a minimum distance from the lower surface of the base greater than or equal to the first distance, preferably equal to the first distance, the proximal end is placed at the maximum distance from the lower surface of the base lower than or equal to the second distance.

9. The device according to claim 1, wherein the top wall is planar or concavely arched or convexly arched.

10. The device according to claim 1, wherein the distal ends of the connecting feet are distant from each other by a distance equal to a length of the central portion of the upper surface.

11. The device according to claim 1, wherein the central portion of the upper surface delimiting the through opening extends longitudinally between the two legs over a length lower than or equal to a length of a shaped edge of the crosspiece facing towards the upper surface of the base and extending longitudinally between the top of the two legs delimiting the through opening above.

12. The device according to claim 1, wherein the distal end is placed at a minimum distance from the lower surface of the base greater than or equal to the first distance, preferably equal to the first distance, the proximal end is placed at the maximum distance from the lower surface of the base lower than or equal to the second distance equal to the second distance, wherein the minimum distance is lower than the maximum distance.

13. The device according to claim 1, wherein the distal ends of the connecting feet are distant from each other by a distance equal to a length of the central portion of the upper surface greater than a thickness of a leg in the crossing direction.

* * * * *